US008485225B2

(12) United States Patent
Veit

(10) Patent No.: US 8,485,225 B2
(45) Date of Patent: Jul. 16, 2013

(54) FLOW CONTROL SCREEN ASSEMBLY HAVING REMOTELY DISABLED REVERSE FLOW CONTROL CAPABILITY

(75) Inventor: Jan Veit, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 257 days.

(21) Appl. No.: 13/172,661

(22) Filed: Jun. 29, 2011

(65) Prior Publication Data

US 2013/0000740 A1 Jan. 3, 2013

(51) Int. Cl.

| | |
|---|---|
| ***F16K 31/00*** | (2006.01) |
| ***F16K 31/44*** | (2006.01) |
| ***E21B 43/00*** | (2006.01) |
| ***E21B 34/06*** | (2006.01) |
| ***E03B 3/18*** | (2006.01) |

(52) U.S. Cl.
USPC ..... 137/624.27; 166/227; 166/373; 251/73

(58) Field of Classification Search
USPC ..... 137/624.27; 166/227, 233, 236, 166/318, 323, 325, 329, 373; 251/73
See application file for complete search history.

(56) References Cited

U.S. PATENT DOCUMENTS

| | | | | |
|---|---|---|---|---|
| 148,387 | A | 3/1874 | Squires | |
| 1,536,348 | A | 5/1925 | Mack | |
| 2,517,841 | A | 8/1950 | Chenault | |
| 2,602,516 | A | 7/1952 | Gray | |
| 4,729,432 | A * | 3/1988 | Helms | 166/317 |
| 5,320,178 | A | 6/1994 | Cornette | |
| 5,337,808 | A | 8/1994 | Graham | |
| 5,435,393 | A | 7/1995 | Brekke et al. | |
| 5,775,421 | A | 7/1998 | Duhon et al. | |
| 5,803,179 | A | 9/1998 | Echols et al. | |
| 5,812,331 | A | 9/1998 | Lopez et al. | |
| 5,896,928 | A | 4/1999 | Coon | |

(Continued)

FOREIGN PATENT DOCUMENTS

| | | |
|---|---|---|
| GB | 2421746 | 7/2006 |
| GB | 2455001 | 7/2009 |

(Continued)

OTHER PUBLICATIONS

International Search Report and Written Opinion, KIPO, PCT/US2012/041794, Feb. 19, 2013.

(Continued)

*Primary Examiner* — William McCalister
*Assistant Examiner* — Frederick D Soski
(74) *Attorney, Agent, or Firm* — Lawrence R. Youst

(57) ABSTRACT

A flow control screen having a flow path between the interior of a base pipe and a filter medium. A valve assembly, including a valve plug, a ball retainer, and a piston body with a collet assembly is disposed within the flow path in an opening of a housing disposed about the base pipe. The collet assembly is radially outwardly constrained by a radially reduced section of the opening in a first position preventing entry of the valve plug therein and radially outwardly unconstrained by the radially reduced section in a second position. Reverse flow is initially prevented as internal differential pressure seats the valve plug on a seat of the opening and causes the piston body to shift to the second position upon reaching a predetermined threshold. Thereafter, external differential pressure causes the valve plug to enter the piston body and contact the ball retainer, thereby allowing reverse flow.

20 Claims, 7 Drawing Sheets

U.S. PATENT DOCUMENTS

| | | | | |
|---|---|---|---|---|
| 6,102,060 | A * | 8/2000 | Howlett et al. | 137/1 |
| 6,112,815 | A | 9/2000 | Boe et al. | |
| 6,112,817 | A | 9/2000 | Voll et al. | |
| 6,343,651 | B1 | 2/2002 | Bixenman | |
| 6,371,210 | B1 | 4/2002 | Bode et al. | |
| 6,470,749 | B1 | 10/2002 | Han et al. | |
| 6,622,794 | B2 | 9/2003 | Zisk, Jr. | |
| 6,644,412 | B2 | 11/2003 | Bode et al. | |
| 6,719,051 | B2 | 4/2004 | Hailey, Jr. et al. | |
| 6,786,285 | B2 | 9/2004 | Johnson et al. | |
| 6,857,476 | B2 | 2/2005 | Richards | |
| 6,883,613 | B2 | 4/2005 | Bode et al. | |
| 6,886,634 | B2 | 5/2005 | Richards | |
| 6,899,176 | B2 | 5/2005 | Hailey, Jr. et al. | |
| 6,978,840 | B2 | 12/2005 | Henderson | |
| 7,055,598 | B2 | 6/2006 | Ross et al. | |
| 7,096,945 | B2 | 8/2006 | Richards et al. | |
| 7,100,686 | B2 | 9/2006 | Wittrisch | |
| 7,152,688 | B2 | 12/2006 | Richards | |
| 7,185,706 | B2 | 3/2007 | Freyer | |
| 7,191,833 | B2 | 3/2007 | Richards | |
| 7,204,316 | B2 | 4/2007 | Dusterhoft et al. | |
| 7,252,153 | B2 | 8/2007 | Hejl et al. | |
| 7,413,022 | B2 | 8/2008 | Broome et al. | |
| 7,426,962 | B2 | 9/2008 | Moen et al. | |
| 7,451,815 | B2 | 11/2008 | Hailey et al. | |
| 7,469,743 | B2 | 12/2008 | Richards | |
| 7,537,056 | B2 | 5/2009 | MacDougall | |
| 7,559,375 | B2 | 7/2009 | Dybevik et al. | |
| 7,708,068 | B2 | 5/2010 | Hailey, Jr. | |
| 7,775,283 | B2 | 8/2010 | Coronado et al. | |
| 7,775,284 | B2 | 8/2010 | Richards et al. | |
| 7,789,145 | B2 | 9/2010 | Patel | |
| 7,802,621 | B2 | 9/2010 | Richards et al. | |
| 7,841,398 | B2 | 11/2010 | Tibbles et al. | |
| 7,891,420 | B2 | 2/2011 | Dale et al. | |
| 7,918,275 | B2 | 4/2011 | Clem | |
| 2006/0186601 | A1 | 8/2006 | Lopez | |
| 2007/0012444 | A1 | 1/2007 | Horgan et al. | |
| 2008/0035330 | A1 | 2/2008 | Richards | |
| 2008/0041580 | A1 | 2/2008 | Freyer et al. | |
| 2008/0041581 | A1 | 2/2008 | Richards | |
| 2008/0041588 | A1 | 2/2008 | Richards et al. | |
| 2008/0283238 | A1 | 11/2008 | Richards et al. | |
| 2009/0000787 | A1 | 1/2009 | Hill et al. | |
| 2009/0065199 | A1 | 3/2009 | Patel et al. | |
| 2009/0133882 | A1 | 5/2009 | Delaloye et al. | |
| 2009/0151925 | A1 | 6/2009 | Richards et al. | |
| 2009/0277650 | A1 | 11/2009 | Casciaro et al. | |
| 2010/0132954 | A1 | 6/2010 | Telfer | |
| 2011/0198097 | A1 | 8/2011 | Moen | |
| 2011/0253391 | A1 * | 10/2011 | Veit et al. | 166/386 |

FOREIGN PATENT DOCUMENTS

| | | |
|---|---|---|
| WO | 02075110 | 9/2002 |
| WO | 2004018837 | 3/2004 |
| WO | 2009048822 | 4/2009 |
| WO | 2009048823 | 4/2009 |
| WO | 2009065793 | 5/2009 |
| WO | 2009065890 | 5/2009 |
| WO | 2009066097 | 5/2009 |
| WO | 2009067021 | 5/2009 |

OTHER PUBLICATIONS

Martin P. Coronado, Next Generation Sand Screen Enables Drill-in Sandface Completions, Offshore (Dec. 2009), pp. 54-56.

* cited by examiner

FLOW CONTROL SCREEN ASSEMBLY HAVING REMOTELY DISABLED REVERSE FLOW CONTROL CAPABILITY

TECHNICAL FIELD OF THE INVENTION

This invention relates, in general, to equipment utilized in conjunction with operations performed in subterranean wells and, in particular, to a flow control screen assembly that is operable to control the inflow of formation fluids and selectively operable to prevent reverse flow of fluids into the formation.

BACKGROUND OF THE INVENTION

Without limiting the scope of the present invention, its background will be described with reference to fluid production from a hydrocarbon bearing subterranean formation, as an example.

During the completion of a well that traverses a hydrocarbon bearing subterranean formation, production tubing and various completion equipment are installed in the well to enable safe and efficient production of the formation fluids. For example, to prevent the production of particulate material from an unconsolidated or loosely consolidated subterranean formation, certain completions include one or more sand control screens positioned proximate the desired production intervals. In other completions, to control the flow rate of production fluids into the production tubing, it is common practice to install one or more flow control devices within the tubing string.

Attempts have been made to utilize fluid flow control devices within completions requiring sand control. For example, in certain sand control screens, after production fluids flows through the filter medium, the fluids are directed into a flow control section. The flow control section may include one or more flow restrictors such as flow tubes, nozzles, labyrinths or the like. Typically, the production rate through these flow control screens is fixed prior to installation by individually adjusting the flow restrictors of the flow control screens.

It has been found, however, that the during the completion process, it may be desirable to pressure up the completion string to operate or set certain tools, such as packers. Current flow control screens require the running of a separate work string into the completion string to achieve this result or require that one or more permanent check valves be incorporated into each of the flow control screens. In addition, it has been found, that it may desirable to allow reverse flow from the completion string into the formation in certain completions requiring fluid flow control, sand control and tool setting capabilities.

Accordingly, a need has arisen for a flow control screen that is operable to control the inflow of formation fluids in a completion requiring sand control. A need has also arisen for such a flow control screen that is operable to be pressured up during the completion process. Further, a need has arisen for such a flow control screen that is operable to selectively allow reverse flow from the completion string into the formation.

SUMMARY OF THE INVENTION

The present invention disclosed herein comprises a flow control screen for controlling the inflow of formation fluids in completions requiring sand control. In addition, the flow control screen of the present invention is operable to be pressured up during the completion process. Further, the flow control screen of the present invention is operable to selectively allow reverse flow from the completion string into the formation.

In one aspect, the present invention is directed to a flow control screen having a fluid flow path between an interior of a base pipe and a filter medium. The flow control screen includes a housing positioned about the base pipe having an opening with a radially reduced portion and a seat. A valve assembly is positioned in the opening and disposed within the fluid flow path. The valve assembly includes a valve plug, a ball retainer and a piston body having a collet assembly. The collet assembly is radially outwardly constrained by the radially reduced portion of the opening, in a first position, to prevent the valve plug from entering in the piston body and radially outwardly unconstrained by the radially reduced portion of the opening, in a second position. Application of an internal differential pressure seats the valve plug on the seat to prevent reverse flow. Application of a predetermined internal differential pressure shifts the piston body from the first position to the second position while continuing to prevent reverse flow. In the second position, application of an external differential pressure causes the valve plug to contact the ball retainer, thereafter allowing reverse flow.

In one embodiment, at least a portion of the collet assembly may be slidably positioned within the radially reduced portion of the opening in the first position. In certain embodiments, operation of the piston body from the first position to the second position may be prevented by a retainer pin extending through the housing until the predetermined internal differential pressure is reached. In some embodiments, the valve plug may be a spherical blocking member. In other embodiments, the collet assembly may have a plurality of collet fingers.

In one embodiment, the ball retainer may be positioned in a ball retainer recess of the piston body. In such embodiments, the ball retainer retains the valve plug in the piston body after the valve plug contacts the ball retainer. For example, the ball retainer may magnetically retain the valve plug in the piston body after the valve plug contacts the ball retainer. This can be achieved if the ball retainer is a magnet and the valve plug is formed from a ferromagnetic material.

In another aspect, the present invention is directed to a flow control screen having a fluid flow path between an interior of a base pipe and a filter medium. The flow control screen includes a housing positioned about the base pipe having plural openings with radially reduced portions and seats. A valve assembly is disposed in each opening and within the fluid flow path. Each valve assembly includes a valve plug, a ball retainer and a piston body having a collet assembly. Each collet assembly is radially outwardly constrained by the radially reduced portion of one of the openings, in a first position, to prevent entry of the valve plug into the piston body and radially outwardly unconstrained by the radially reduced portion, in a second position. Application of an internal differential pressure seats the valve plugs on the seats to prevent reverse flow. Application of a predetermined internal differential pressure shifts the piston bodies from the first position to the second position while continuing to prevent reverse flow. In the second position, application of an external differential pressure causes the valve plugs to contact the ball retainers, thereafter allowing reverse flow.

In a further aspect, the present invention is directed to a method for operating a flow control screen. The method involves disposing at least one piston body within a fluid flow path between an interior of a base pipe and a filter medium, the piston body is located in an opening of a housing positioned about the base pipe; disposing a valve plug within the opening between a seat of the opening and a collet assembly of the piston body; preventing entry of the valve plug into the piston body by radially outwardly constraining the collet assembly in a first position of the piston body; applying an internal differential pressure to seat the valve plug on the seat and prevent reverse flow; applying a predetermined internal differential pressure to shift the piston body from the first position to a second position while continuing to prevent reverse flow; and applying an external differential pressure to move the valve plug into contact with a ball retainer in the piston body, thereafter allowing reverse flow.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
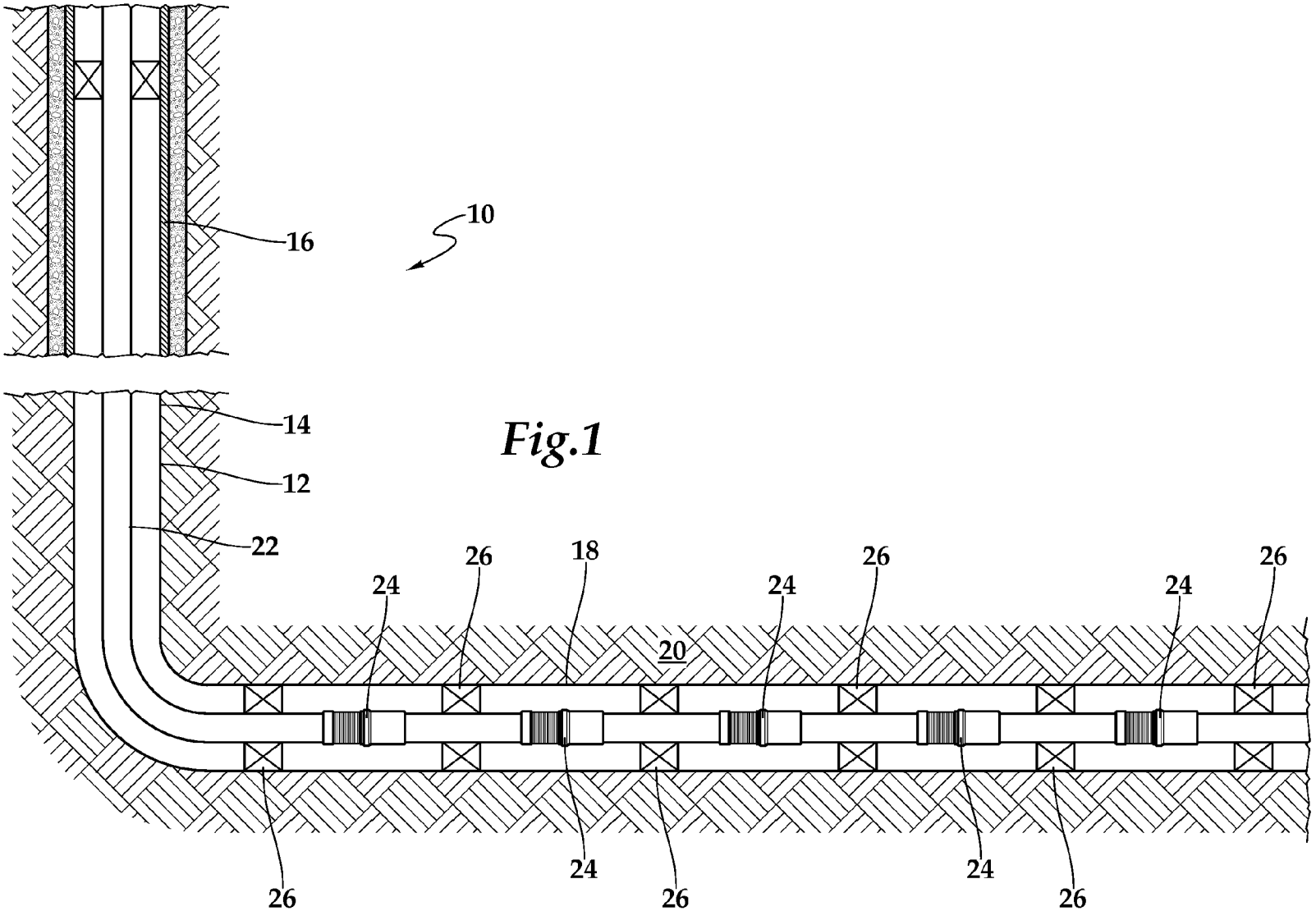
FIG. 1 is a schematic illustration of a well system operating a plurality of flow control screens according to an embodiment of the present invention.

Referring initially to FIG. 1, therein is depicted a well system including a plurality of flow control screens embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and injection fluids to travel from the surface to formation 20. At its lower end, tubing string 22 is coupled to a completions string that has been installed in wellbore 12 and divides the completion interval into various production intervals adjacent to formation 20. The completion string includes a plurality of flow control screens 24, each of which is positioned between a pair of packers 26 that provides a fluid seal between the completion string and wellbore 12, thereby defining the production intervals.

Flow control screens 24 serve the primary functions of filtering particulate matter out of the production fluid stream and controlling the flow rate of the production fluid stream. In addition, as discussed in greater detail below, flow control screens 24 are operable to be pressured up during installation of the completion string. For example, when the completion string is positioned in the desired location in wellbore 12, internal pressure may be used to set packers 26 to divide the completion interval into the desired number of production intervals. During this setting process, flow control screens 24 are in their running configuration in which they are operable to hold pressure for repeated cycles as long as the pressure remains below a predetermined threshold pressure. Once all pressure operated completion components are set or during the setting of the final pressure operated completion component, the internal pressure may be raised above the predetermined threshold pressure to operate flow control screens 24 into their sheared configuration. In this configuration, flow control screens continue to hold pressure, however, when the internal pressure is released and the differential pressure across flow control screens 24 is positive between the outside and inside of flow control screens 24, flow control screens 24 are operated to their production configuration.

Even though FIG. 1 depicts the flow control screens of the present invention in an open hole environment, it should be understood by those skilled in the art that the flow control screens of the present invention are equally well suited for use in cased wells. Also, even though FIG. 1 depicts one flow control screen in each production interval, it should be understood by those skilled in the art that any number of flow control screens of the present invention may be deployed within a production interval without departing from the principles of the present invention. In addition, even though FIG. 1 depicts the flow control screens of the present invention in a horizontal section of the wellbore, it should be understood by those skilled in the art that the flow control screens of the present invention are equally well suited for use in wells having other directional configurations including vertical wells, deviated well, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2A:
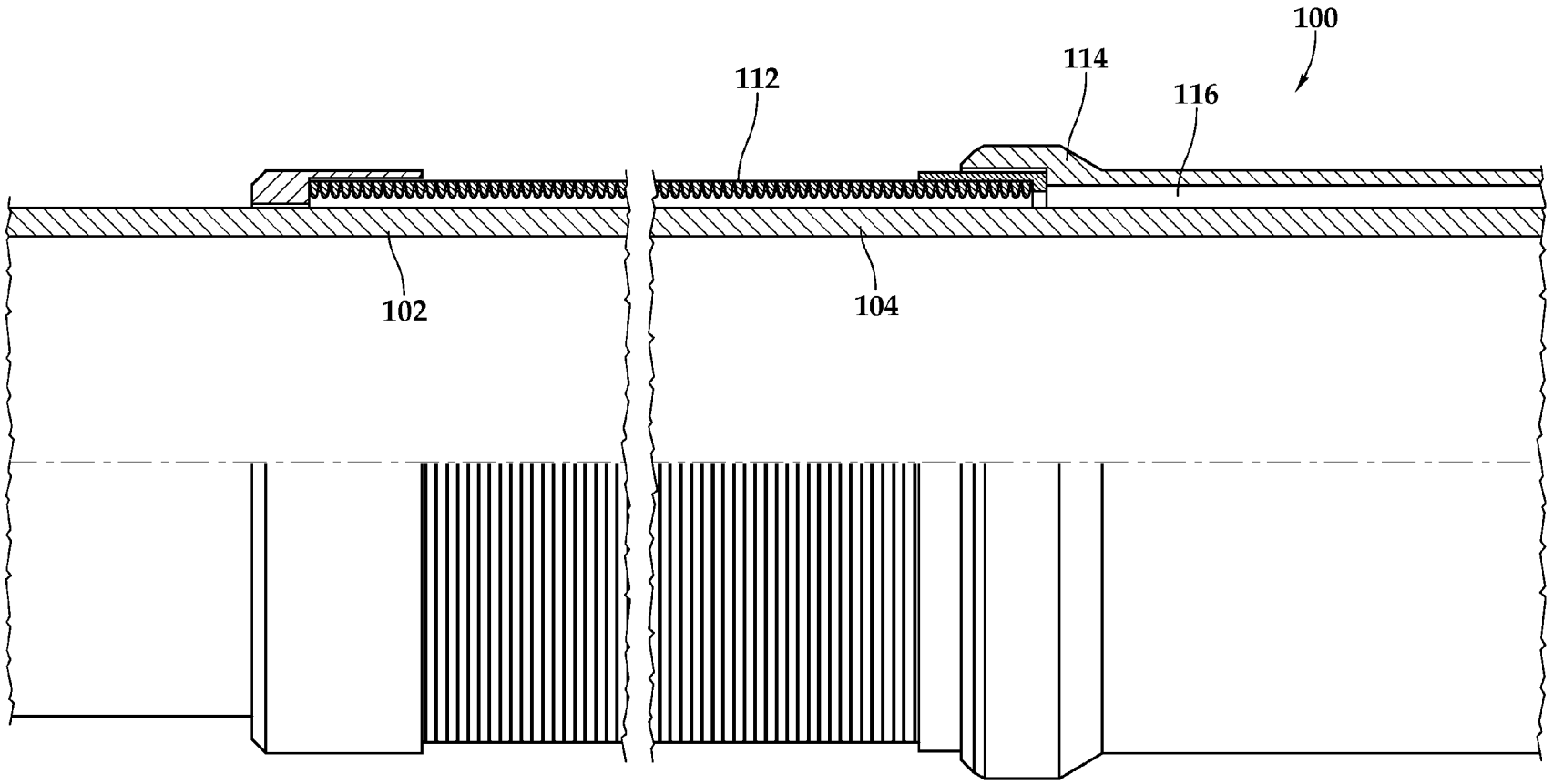
FIGS. 2A-2C are quarter sectional views of successive axial sections of a flow control screen according to an embodiment of the present invention.
Figure 2B:
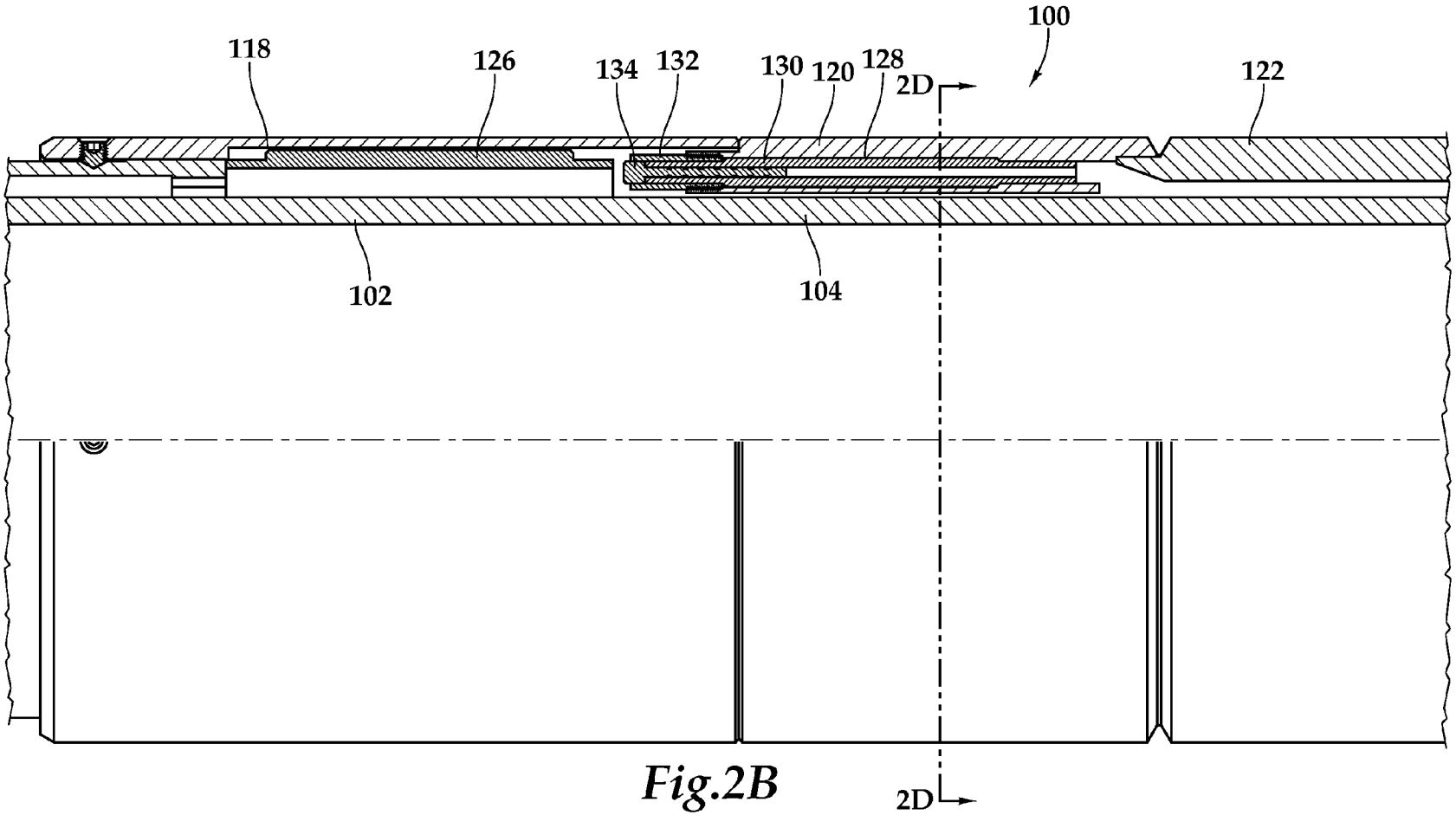
Figure 2C:
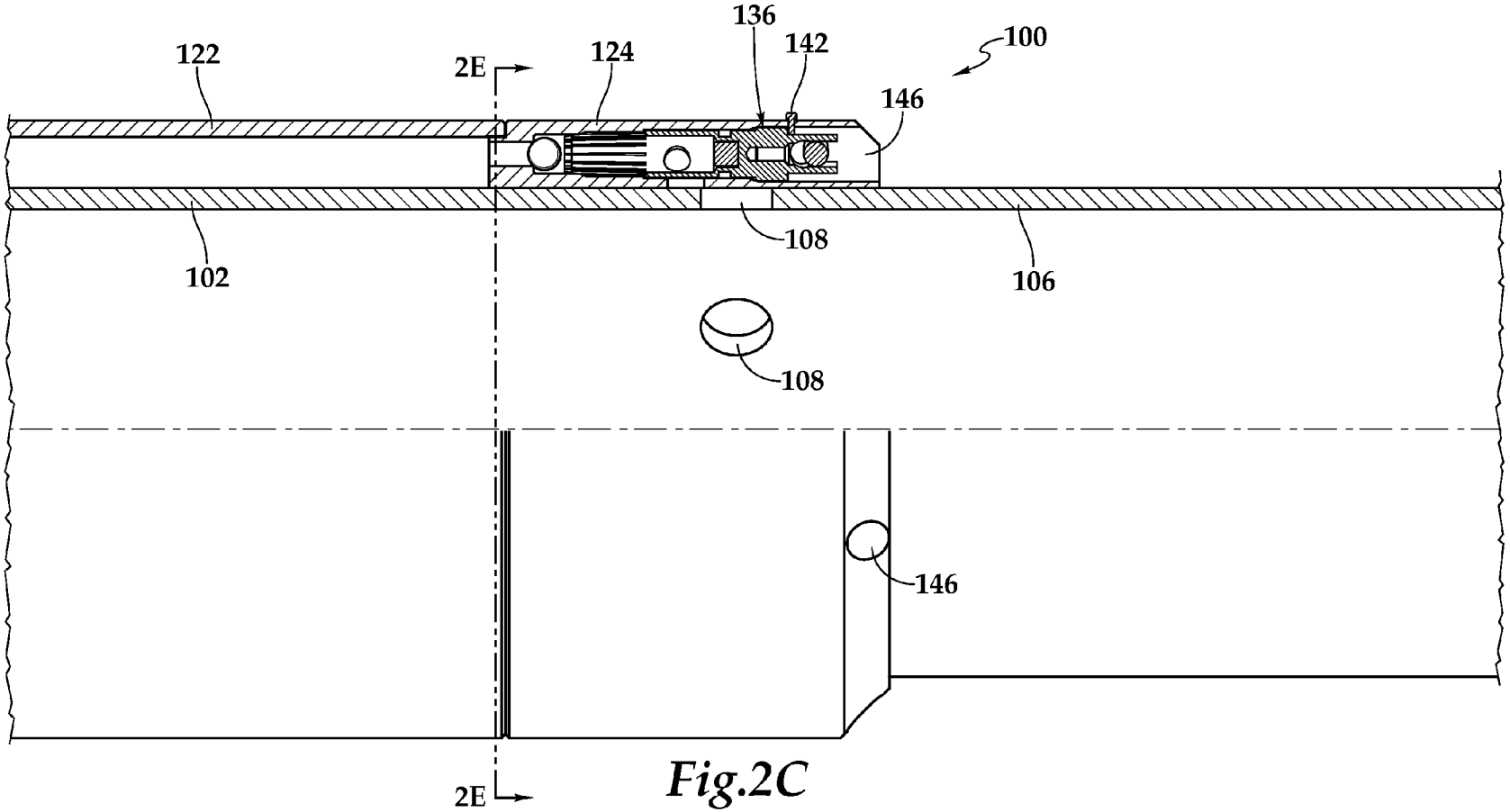

Referring next to FIGS. 2A-2C, therein is depicted successive axial sections of a flow control screen according to the present invention that is representatively illustrated and generally designated 100. Flow control screen 100 may be suitably coupled to other similar flow control screens, production packers, locating nipples, production tubulars or other downhole tools to form a completions string as described above. Flow control screen 100 includes a base pipe 102 that has a blank pipe section 104 and a perforated section 106 including a plurality of production ports 108. Positioned around an uphole portion of blank pipe section 104 is a screen element or filter medium 112, such as a wire wrap screen, a woven wire mesh screen, a prepacked screen or the like, designed to allow fluids to flow therethrough but prevent particulate matter of a predetermined size from flowing therethrough. Positioned downhole of filter medium 112 is a screen interface housing 114 that forms an annulus 116 with base pipe 102. Securably connected to the downhole end of screen interface housing 114 is a sleeve housing 118. At its downhole end, sleeve housing 118 is securably connected to a flow tube housing 120 which is securably connected to the uphole end of an intermediate housing 122. In addition, flow tube housing 120 is preferably securably connected or sealably coupled to base pipe 102 to prevent fluid flow therebetween. Toward its downhole end, intermediate housing 122 is securably connected to a valve assembly housing 124 which is preferably welded to base pipe 102 at its downhole end. The various connections of the housing sections may be made in any suitable fashion including welding, threading and the like as well as through the use of fasteners such as pins, set screws and the like. Together, the housing sections create a generally annular fluid flow path between filter medium 112 and perforated section 106 of base pipe 102.

Figure 2D:
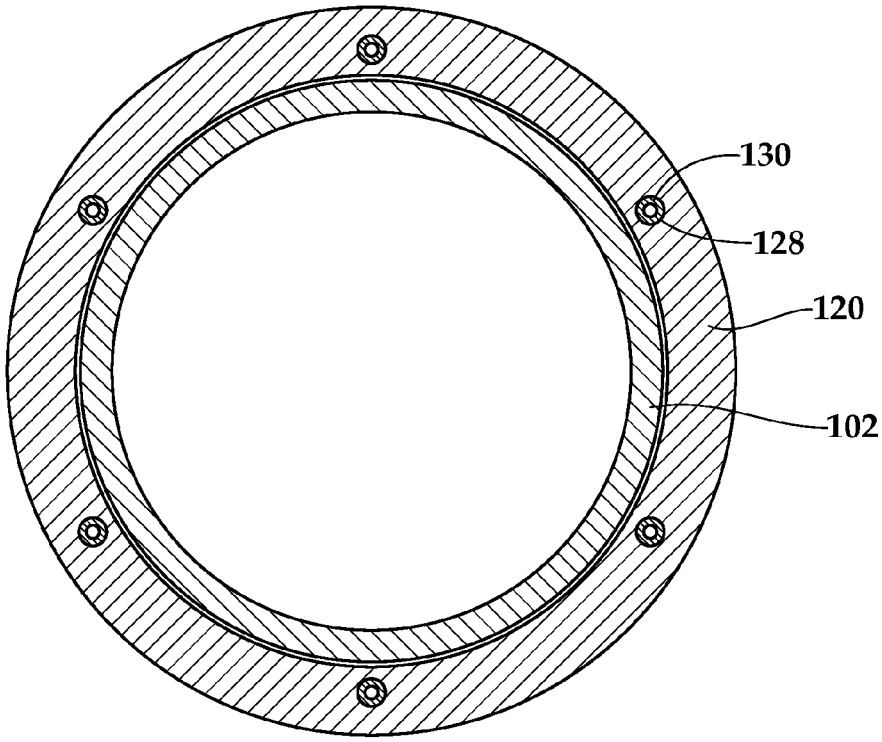
FIG. 2D is a cross sectional view of the flow control screen of FIG. 2B taken along line 2D-2D.

Positioned in the annular region between housing sleeve 118 and base pipe 102 is a split ring spacer 126. Positioned within a plurality of axial openings 128 in flow tube housing 120 are flow tubes 130 that form a fluid flow control section of flow control screen 100. As best seen in FIG. 2D, the illustrated embodiment includes six axial openings 128 and six flow tubes 130, however, those skilled in the art will recognize that other numbers of flow tubes both greater than and less than six could alternatively be used and would be considered within the scope of the present invention. Each of the flow tubes 130 is secured within flow tube housing 120 by a threaded retaining sleeve 132. One or more of the flow tube 130 may have a threaded cap or a plug 134 associated therewith to inhibit or stop flow therethrough. The use of plugs 134 and flow tubes 130 having various inner lengths and diameters allow an operator to adjust the pressure drop rating of each flow control screen 100 to a desired level such that a completion string including a plurality of flow control screens 100 is operable to counteract heel-toe effects in long horizontal completions, balance inflow in highly deviated and fractured wells, reduce annular sand transportation and reduce water/gas influx, thereby lengthening the productive life of the well.

Figure 2E:
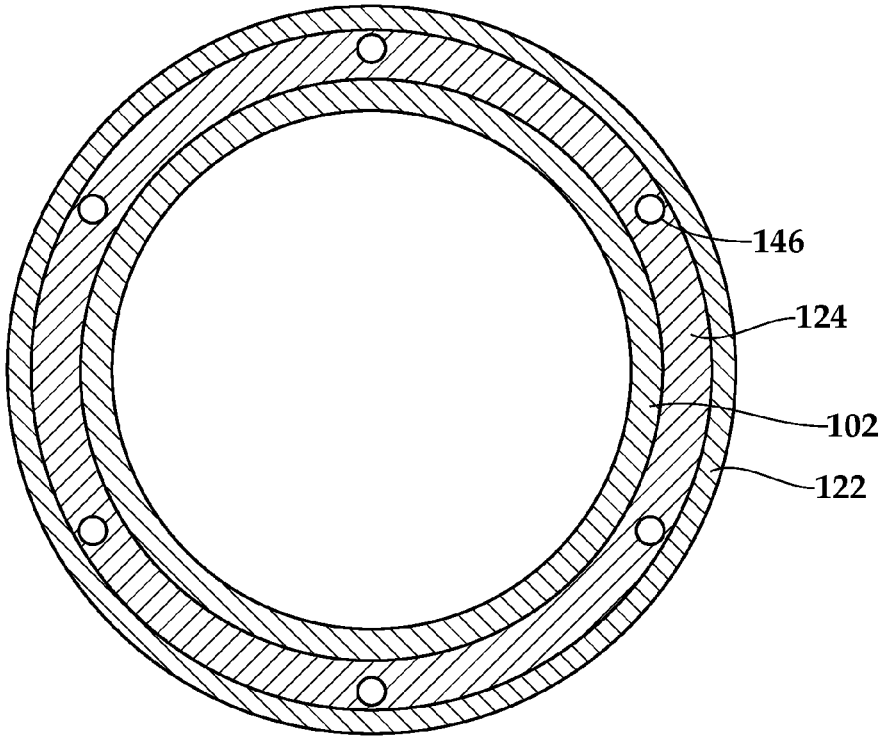
FIG. 2E is a cross sectional view of the flow control screen of FIG. 2C taken along line 2E-2E.

Positioned within a plurality of axial openings 146 in valve assembly housing 124 are valve assemblies 136 that form a reverse fluid flow control section of flow control screen 100. As best seen in FIG. 2E, the illustrated embodiment includes six axial openings 146 for six valve assemblies 136, however, those skilled in the art will recognize that other numbers of valve assemblies both greater than and less than six could alternatively be used and would be considered within the scope of the present invention.

Figure 4:
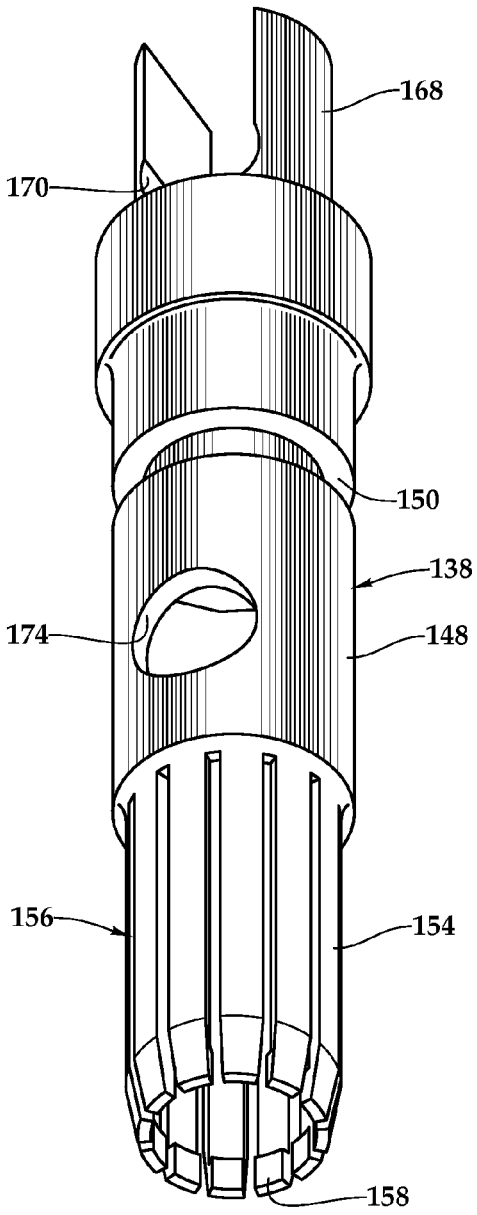
FIG. 4 is an isometric view of a piston assembly of a valve assembly that is operable for use in a flow control screen according to an embodiment of the present invention.
Figure 5:
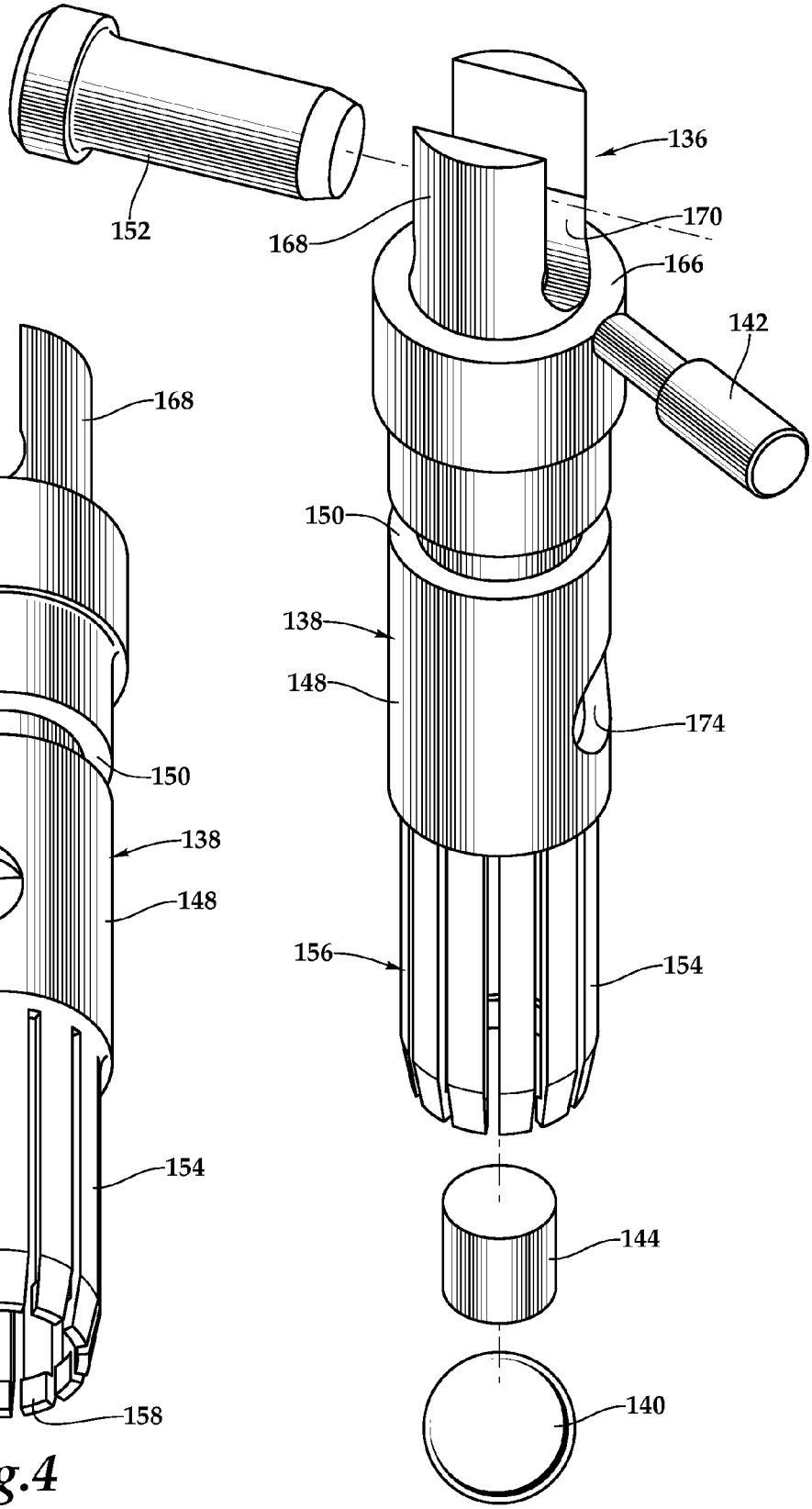
FIG. 5 is an exploded view of a valve assembly that is operable for use in a flow control screen according to an embodiment of the present invention.

Referring next to FIGS. 3A-3E, valve assembly 136 will now be described in its various configurations. Valve assembly 136 includes a piston assembly 138, a valve plug 140, a retainer pin 142, a ball retainer 144 and a retainer pin 152, as best seen in FIG. 5. Piston assembly 138 includes a piston body 148 having an o-ring groove 150 and a plurality of integrally extending collet fingers 154 forming a collet assembly 156, as best seen in FIG. 4. At the distal ends thereof, each collet finger 154 includes a lip 158. As explained in greater detail below, collet fingers 154 of collet assembly 156 are radially outwardly constrained in a first operating position of valve assembly 136 to prevent entry of valve plug 140 within piston body 148 and radially outwardly unconstrained in a second operating position of valve assembly 136 to allow entry and retention of valve plug 140 within piston body 148.

Figure 3A:
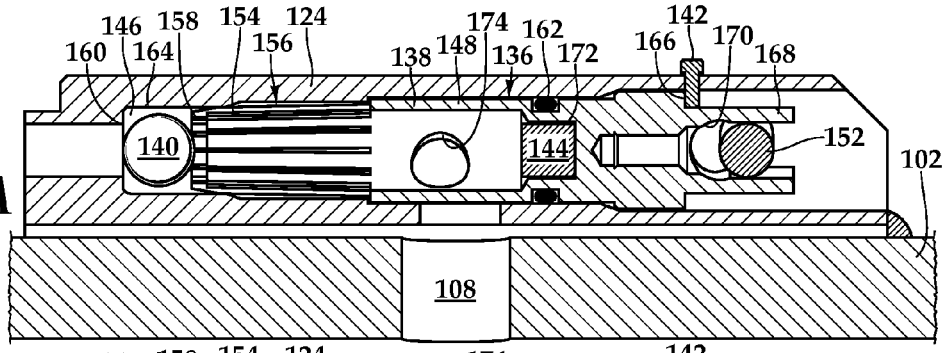
FIGS. 3A-3E are cross sectional views of a valve assembly in its various operating configurations that is operable for use in a flow control screen according to an embodiment of the present invention.

Valve plugs 140 are depicted as spherical blocking members and are initially allowed to move within an uphole portion of axial openings 146 between a sealing surface of valve assembly housing 124 depicted as seat 160 and lips 158, as best seen in FIG. 3A. Those skilled in the art will recognize, however, that even though valve plugs 140 are depicted as spherical in shape, valve plugs 140 could have alternate shapes including cylindrical configurations, substantially cylindrical configurations or other configurations so long as valve plugs 140 are capable of creating a seal with seat 160 of valve assembly housing 124 and of being received and retained in piston body 148, as described below. As illustrated, uphole travel of each valve plug 140 is limited by seat 160 and downhole travel of valve plug 140 is initially limited by lips 158 of collet fingers 154. In this embodiment, a radially reduced inner diameter portion 164 of axial openings 146 is sized to receive collet fingers 154 therein such that collet fingers 154 are radially outwardly constrained to prevent entry of valve plug 140 within piston body 148.

Piston assembly 138 also includes a shoulder 166, a pin receiver 168 having a radiused inner section 170, a ball retainer recess 172 and a fluid port 174. Each piston assembly 138 is retained within one of the axial openings 146 by retainer pin 142 and retainer pin 152. Axial movement of piston assembly 138 is initially prevented by retainer pin 142. A seal, depicted as o-ring 162, prevents fluid travel around piston assembly 138 through opening 146.

Figure 3B:
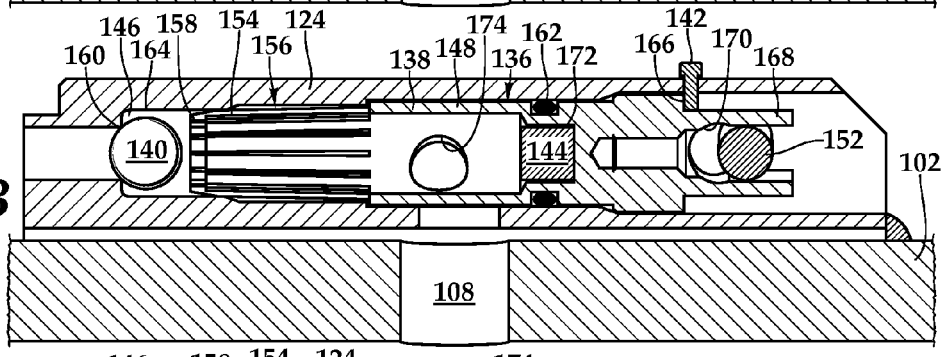

FIG. 3A represents the running configuration of flow control screen 100 in which valve assemblies 136 are secured within valve assembly housing 124 and valve plugs 140 are disposed within the uphole ends of axial openings 146. In this configuration, an internal differential pressure, wherein the pressure inside of base pipe 102 is greater than the pressure outside of base pipe 102, may be applied to the tubular string deploying flow control screens 100. Specifically, the internal differential pressure will travel through production ports 108 but reverse flow through flow control screens 100 is prevented by valve assemblies 136 as valve plugs 140 are sealed against seats 160, as best seen in FIG. 3B. Repeated pressure cycles may be applied to the tubular as long as the pressure remains below the shear pressure of retainer pins 142.

Figure 3C:
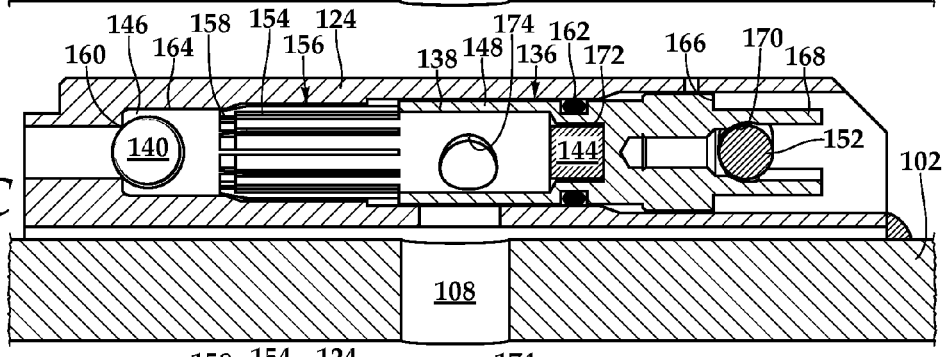
Figure 3D:
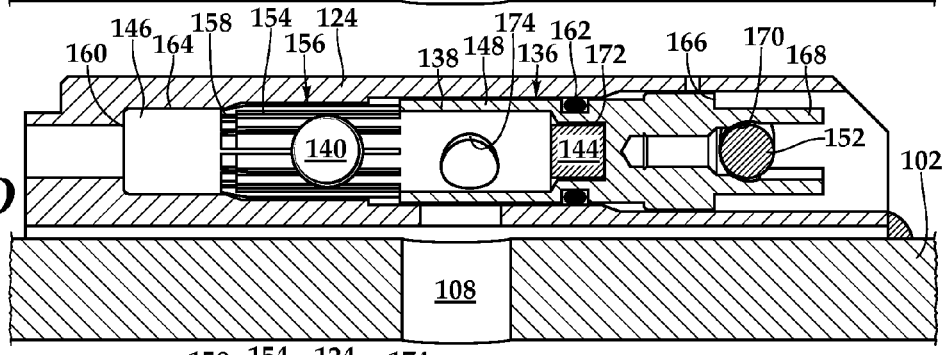
Figure 3E:
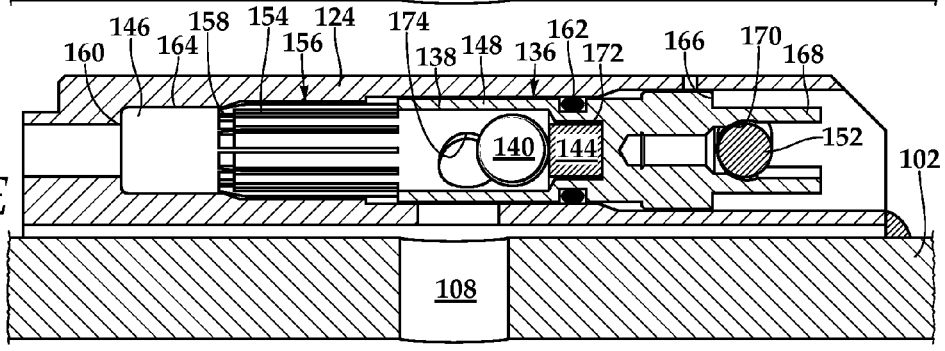

When it is desired to operate flow control screens 100 from the running configuration to the sheared configuration, the internal differential pressure may be raised to a predetermined threshold pressure above the shear pressure of retainer pins 142 causing retainer pins 142 to shear and piston assemblies 138 to shift to the right until surface 170 contacts retainer pin 152, as best seen in FIG. 3C. In this configuration, valve assemblies 136 continue to hold pressure and prevent reverse fluid flow through flow control screens 100 from production ports 108 to filter medium 112. Once the internal differential pressure is released and an external differential pressure, wherein the pressure outside base pipe 102 is greater than the pressure inside base pipe 102, is applied to flow control screens 100, valve plugs 140 enter piston assemblies 138 as radially outward movement of collet fingers 154 is no longer disallowed by inner diameter portion 164 of axial openings 146, as best seen in FIG. 3D. Once each valve plug 140 enters a piston assembly 138 it travels downhole until it contacts ball retainer 144, as best seen in FIG. 3E. In the illustrated embodiment, ball retainer 144 is positioned in ball retainer recess 172 of piston body 148 and is depicted as a magnet. In this embodiment, the material of ball retainer 144 produces a magnetic field that is operable to retain ball retainer 144 in ball retainer recess 172. Likewise, the magnetic field of ball retainer 144 is operable to attract and retain valve plug 140, which is preferable formed from a ferromagnetic material, in the position shown in FIG. 3E. Once contact between valve plug 140 and ball retainer 144 is established, valve assemblies 136 no longer prevent reverse fluid flow, thereby placing flow control screens 100 in their production and injection configuration.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A flow control screen having a fluid flow path between an interior of a base pipe and a filter medium, the flow control screen comprising:

a housing positioned about the base pipe having an opening with a radially reduced portion and a seat; and a valve assembly positioned in the opening and disposed within the fluid flow path including a valve plug, a ball retainer and a piston body having a collet assembly that is radially outwardly constrained by the radially reduced portion of the opening in a first position to prevent the valve plug from entering in the piston body and radially outwardly unconstrained by the radially reduced portion of the opening in a second position, wherein an internal differential pressure seats the valve plug on the seat to prevent reverse flow;

wherein a predetermined internal differential pressure shifts the piston body from the first to the second position while continuing to prevent reverse flow; and wherein, in the second position, an external differential pressure causes the valve plug to contact the ball retainer, thereafter allowing reverse flow.

2. The flow control screen as recited in claim 1 wherein at least a portion of the collet assembly is slidably positioned within the radially reduced portion of the opening in the first position.

3. The flow control screen as recited in claim 1 wherein operation of the piston body from the first position to the second position is prevented by a retainer pin extending through the housing until the predetermined internal differential pressure is reached.

4. The flow control screen as recited in claim 1 wherein the valve plug further comprises a spherical blocking member.

5. The flow control screen as recited in claim 1 wherein the collet assembly further comprises a plurality of collet fingers.

6. The flow control screen as recited in claim 1 wherein the ball retainer is positioned in a ball retainer recess of the piston body.

7. The flow control screen as recited in claim 1 wherein the ball retainer retains the valve plug in the piston body after the valve plug contacts the ball retainer.

8. The flow control screen as recited in claim 1 wherein the ball retainer magnetically retains the valve plug in the piston body after the valve plug contacts the ball retainer.

9. The flow control screen as recited in claim 1 wherein the ball retainer further comprises a magnet and the valve plug is formed from a ferromagnetic material.

10. A flow control screen having a fluid flow path between an interior of a base pipe and a filter medium, the flow control screen comprising:

a housing positioned about the base pipe having plural openings with radially reduced portions and seats; and a valve assembly disposed in each opening and within the fluid flow path, each valve assembly including a valve plug, a ball retainer and a piston body having a collet assembly that is radially outwardly constrained by the radially reduced portion of one of the openings in a first position to prevent entry of the valve plug into the piston body and radially outwardly unconstrained by the radially reduced portion in a second position, wherein an internal differential pressure seats the valve plugs on the seats to prevent reverse flow;

wherein a predetermined internal differential pressure shifts the piston bodies from the first to the second position while continuing to prevent reverse flow; and wherein, in the second operating position, an external differential pressure causes the valve plugs to contact the ball retainers, thereafter allowing reverse flow.

11. The flow control screen as recited in claim 10 wherein at least a portion of the collet assemblies is slidably positioned within the radially reduced portions of the openings in the first position.

12. The flow control screen as recited in claim 10 wherein operation of the piston bodies from the first position to the second position is prevented by retainer pins extending through the housing until the predetermined internal differential pressure is reached.

13. The flow control screen as recited in claim 10 wherein the valve plugs further comprise spherical blocking members.

14. The flow control screen as recited in claim 10 wherein the collet assemblies further comprise a plurality of collet fingers.

15. The flow control screen as recited in claim 10 wherein the ball retainers are positioned in ball retainer recesses of the piston bodies.

16. The flow control screen as recited in claim 10 wherein the ball retainers retain the valve plugs in the piston bodies after the valve plugs contact the ball retainers.

17. The flow control screen as recited in claim 10 wherein the ball retainers magnetically retain the valve plugs in the piston bodies after the valve plugs contact the ball retainers.

18. The flow control screen as recited in claim 10 wherein the ball retainers further comprise magnets and the valve plugs are formed from a ferromagnetic material.

19. A method for operating a flow control screen comprising:

disposing at least one piston body within a fluid flow path between an interior of a base pipe and a filter medium, the piston body located in an opening of a housing positioned about the base pipe;

disposing a valve plug within the opening between a seat of the opening and a collet assembly of the piston body;

preventing entry of the valve plug into the piston body by radially outwardly constraining the collet assembly in a first position of the piston body;

applying an internal differential pressure to seat the valve plug on the seat and prevent reverse flow;

applying a predetermined internal differential pressure to shift the piston body from the first position to a second position while continuing to prevent reverse flow; and applying an external differential pressure to move the valve plug into contact with a ball retainer in the piston body, thereafter allowing reverse flow.

20. The method as recited in claim 19 further comprising magnetically retaining the valve plug in the piston body.

* * * * *